US010607580B2

(12) United States Patent
Dicksinson

(10) Patent No.: US 10,607,580 B2
(45) Date of Patent: Mar. 31, 2020

(54) INTONATION SYSTEM FOR STRINGED INSTRUMENTS

(71) Applicant: Jay S. Dicksinson, Portland, OR (US)

(72) Inventor: Jay S. Dicksinson, Portland, OR (US)

( * ) Notice: Subject to any disclaimer, the term of this patent is extended or adjusted under 35 U.S.C. 154(b) by 0 days.

(21) Appl. No.: 15/990,224

(22) Filed: May 25, 2018

(65) Prior Publication Data

US 2019/0362693 A1 Nov. 28, 2019

(51) Int. Cl.
*G10D 3/04* (2020.01)
*G10D 3/06* (2020.01)

(52) U.S. Cl.
CPC ..... *G10D 3/04* (2013.01); *G10D 3/06* (2013.01)

(58) Field of Classification Search
CPC ..... G10D 3/04
See application file for complete search history.

(56) References Cited

U.S. PATENT DOCUMENTS 462,869 A * 11/1891 Mendenhall et al. ... G10D 3/04 84/299
490,528 A * 1/1893 Wooster ..... G10D 3/04 84/298
615,053 A * 11/1898 Utt ..... G10D 3/04 84/299
2,565,253 A 8/1951 Melita
2,740,313 A * 4/1956 McCarty ..... G10D 3/04 84/298
2,846,915 A * 8/1958 Daria ..... G10D 3/04 84/307
2,959,085 A 11/1960 Porter
3,149,526 A * 9/1964 Ditzel ..... G10D 3/04 84/298
3,178,985 A * 4/1965 Jeranson ..... G10D 3/04 84/307
3,429,214 A * 2/1969 Jones, Sr. ..... G10D 3/12 84/314 N
3,599,524 A * 8/1971 Jones ..... G10D 3/12 84/271
3,605,545 A 9/1971 Rendell
4,031,799 A * 6/1977 Fender ..... G10D 3/04 84/298
4,248,126 A * 2/1981 Lieber ..... G10D 3/04 84/299

(Continued)

OTHER PUBLICATIONS

USPTO, Final Office Action, dated Jul. 12, 2019, in U.S. Appl. No. 16/213,271.

*Primary Examiner* — Robert W Horn
(74) *Attorney, Agent, or Firm* — Chernoff, Vilhauer, McClung & Stenzel, LLP

(57) ABSTRACT

An intonation system for a stringed musical instrument and a stringed instrument including the intonation system. An instrument such as a guitar includes a bridge having bridge string saddles that can be adjusted separately to raise or lower a single string and to adjust the position of the bridge end of the vibrating length of the string. The instrument also includes a nut having nut string saddles that are adjustable individually to adjust the position of the nut end of the string. The structures by which the string saddle positions are adjusted are substantially concealed, largely retaining a conventional appearance of the musical instrument.

12 Claims, 8 Drawing Sheets

(56) References Cited

U.S. PATENT DOCUMENTS 4,281,576 A * 8/1981 Fender ..... G10D 3/04 84/298
4,304,163 A 12/1981 Siminoff
4,430,919 A * 2/1984 Matsui ..... G10D 3/04 84/299
4,541,320 A * 9/1985 Sciuto ..... G10D 3/12 84/298
4,768,414 A * 9/1988 Wheelwright ..... G10D 3/04 84/298
4,867,031 A * 9/1989 Fender ..... G10D 3/146 84/313
5,208,410 A * 5/1993 Foley ..... G10D 3/04 84/298
5,404,783 A * 4/1995 Feiten ..... G10D 3/04 84/298
5,410,936 A * 5/1995 Ellsworth ..... G10D 3/04 84/267
5,481,956 A * 1/1996 LoJacono ..... G10D 3/04 84/314 N
5,689,075 A * 11/1997 Rose ..... G10D 3/04 84/213
5,750,910 A * 5/1998 LoJacono ..... G10D 3/04 84/314 N
5,986,190 A 11/1999 Wolff et al.
6,156,962 A 12/2000 Poort
6,433,264 B1 * 8/2002 Gimpel ..... G10D 3/12 84/314 N
6,521,819 B1 * 2/2003 Di Iorio ..... G10D 3/04 84/298
6,583,346 B2 * 6/2003 LoJacono ..... G10D 3/06 84/314 N
6,686,523 B1 * 2/2004 Devereaux ..... G10D 3/04 84/290
6,706,957 B1 3/2004 Merkel
7,327,109 B1 * 2/2008 Hagen ..... G10D 3/04 318/298
7,563,968 B2 * 7/2009 Medas ..... G10D 3/04 84/298
7,638,697 B2 * 12/2009 Moore ..... G10D 3/04 84/173
8,294,012 B1 10/2012 Garrick
8,748,718 B2 6/2014 Pederson
9,449,587 B2 * 9/2016 Babicz, Sr. ..... G10D 3/04
9,799,310 B2 10/2017 Damaschke et al.
10,163,424 B2 * 12/2018 Colas ..... G10D 1/085
2006/0042449 A1 * 3/2006 Chang ..... G10D 3/04 84/298
2010/0005944 A1 1/2010 Eliasson et al.
2010/0319514 A1 * 12/2010 Aires ..... G10D 3/04 84/298
2019/0362693 A1 * 11/2019 Dickinson ..... G10D 3/06
2019/0362694 A1 * 11/2019 Dickinson ..... G10D 3/12

* cited by examiner

INTONATION SYSTEM FOR STRINGED INSTRUMENTS

BACKGROUND OF THE INVENTION

The present invention relates to stringed musical instruments having finger boards including frets, and relates particularly to intonation of such a musical instrument by adjusting the positions of the open strings in order to improve the ability of the instrument to produce musical notes as accurately as practical throughout the entire designed tonal range of each string.

Stringed instruments such as lutes, guitars, banjos, and mandolins have several strings extending parallel with one another and held in tension, extending between two fixed supports, a nut at an outer end of a neck and a bridge mounted on a body from which the neck extends. The distance between the nut and the bridge is the open length of a string and thus establishes its fundamental tone when the string is placed in tension. A fingerboard including frets is included in the neck, so that a string can be made to sound a note higher than its fundamental tone by fretting the string, that is, by pressing the string against the neck adjacent to one of the frets.

Several factors contribute to determine whether a fretted string will produce the desired note. The material of which the string is made, the action height of the instrument (the distance between an open string and the frets), the thickness, or gauge, of the string, the tension of the string when it is tuned to its intended fundamental tone, and the length of the open string all affect the accuracy of the tone produced when the string is pressed against a fret that is located accurately on the fingerboard. Even the structure of the body of the instrument has an effect, since the top of the body is effectively a sound board that vibrates and thus may make a string vibrate as if it were a little longer than the actual distance between the nut and the bridge saddle.

While various adjustable guitar bridges and nuts are known, they present a non-traditional, technical, appearance that detracts from the traditional appearance of a guitar or other acoustic stringed instrument. What is desired, then, is a stringed instrument including the capacity for its intonation to be optimized string-by-string, yet having a traditional, non-mechanical appearance.

SUMMARY OF THE INVENTION

A stringed instrument, in particular a guitar disclosed herein incorporates a system for intonation that can be used to adjust each string of the instrument, at the nut and at the bridge, so that the resulting note produced by the string will be as close as practical to the intended note when the string is fretted at any of the available frets.

In one embodiment of the system for intonation disclosed herein, a bridge mounted on the body of an instrument includes a set of separate string saddles, one for each string, carried on a base member of the bridge. Each of the string saddles is separately movable with respect to the base member of the bridge, through an available range of possible positions in the direction toward or away from the nut.

In one embodiment of the bridge disclosed herein a frictional member helps to prevent movement of the string saddle with respect to the base member of the bridge when a string supported on that string saddle is in tension.

In one embodiment of the bridge disclosed herein a string saddle is mated with a saddle base member held in a receptacle defined in the base member of the bridge and the string saddle is readily movable with respect to the saddle base member by use of an adjustment tool.

In one embodiment of the bridge disclosed herein a shim may be placed under a saddle base member to raise the related string saddle with respect to the bridge base member.

In one embodiment of the bridge disclosed herein, a string saddle includes a spring pressing against a saddle base member so as to move the string saddle slightly, when a related string is not in tension, to a position in which the string saddle is readily movable, but is also urged against an adjacent surface with sufficient pressure to prevent the string saddle from moving without intentionally being moved.

In one embodiment of the intonation system disclosed herein an adjustable nut assembly includes a separate nut saddle for each string, and each of the nut saddles is held in a respective nut saddle cavity in a nut base member.

In one embodiment of the adjustable nut assembly disclosed herein each nut saddle includes an adjustment mechanism by which the nut saddle may be made to fit in its respective nut saddle cavity at a selected position with respect to the nut base member, adjusted in a direction toward or away from the bridge of the stringed instrument.

The foregoing and other features and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
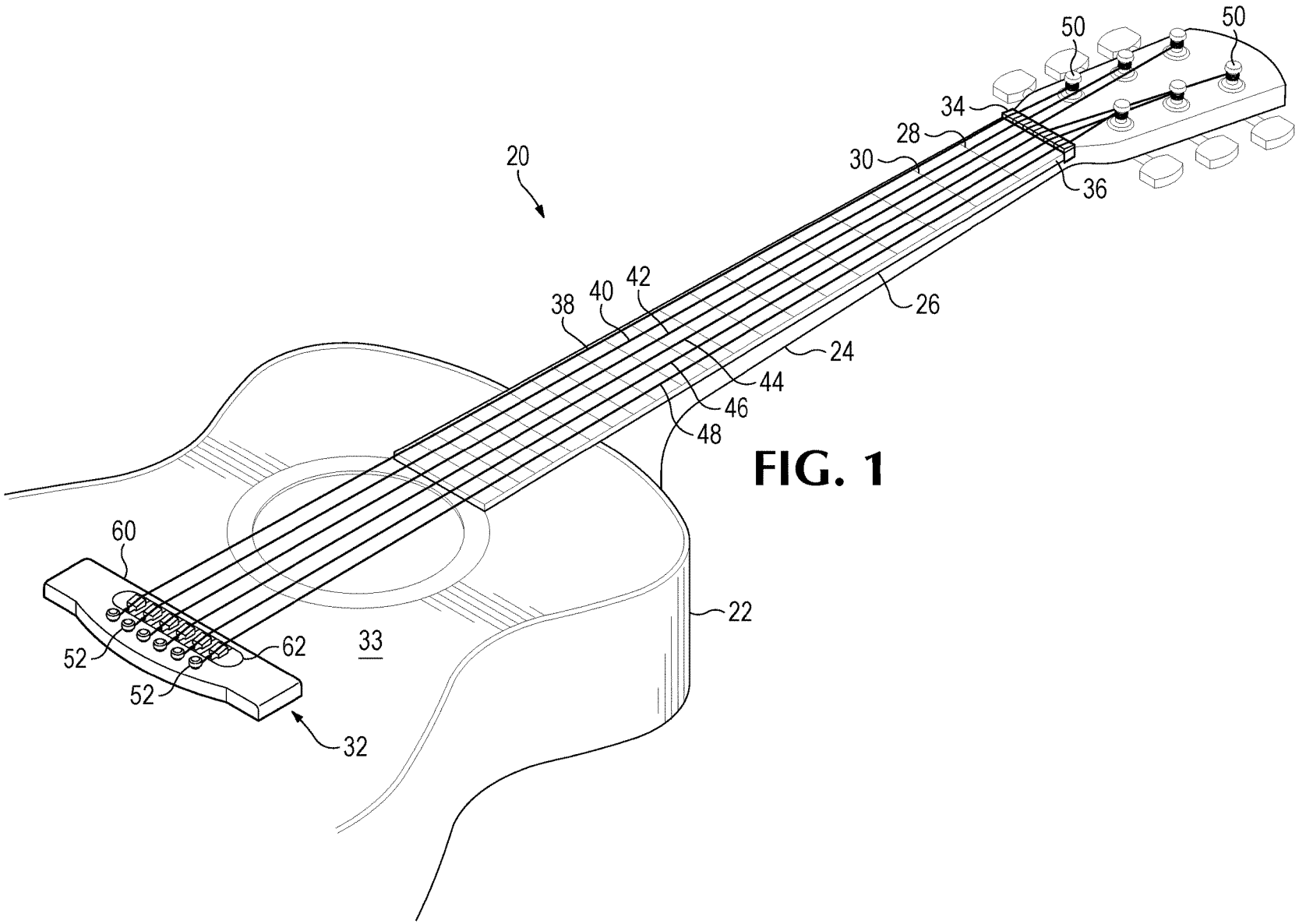
FIG. 1 is an isometric view of an acoustic guitar including an intonation system embodying the present invention.
Figure 2:
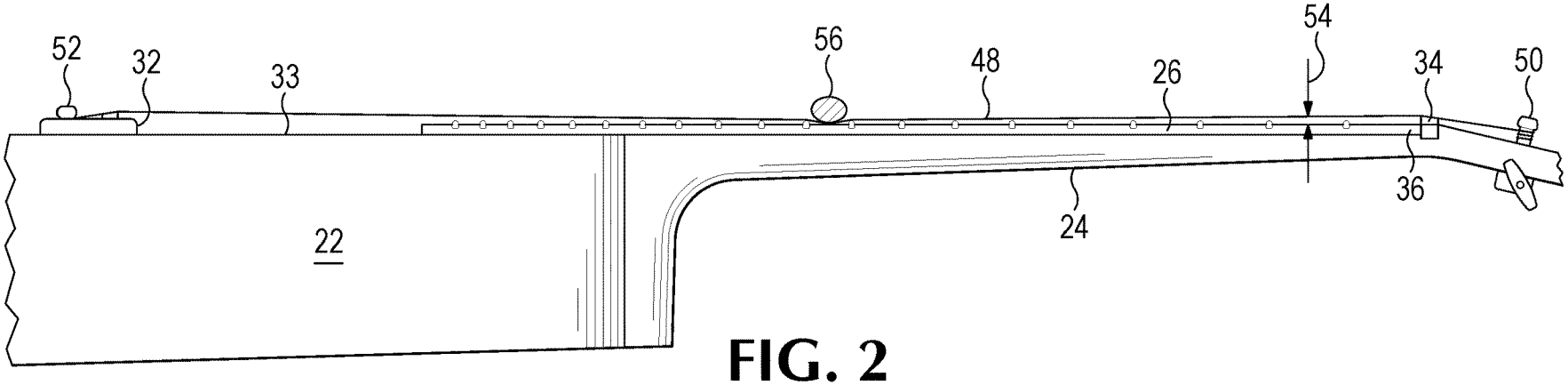
FIG. 2 is a side elevational view of the guitar shown in FIG. 1, showing one of the strings fretted near the middle of its length.
Figure 3:
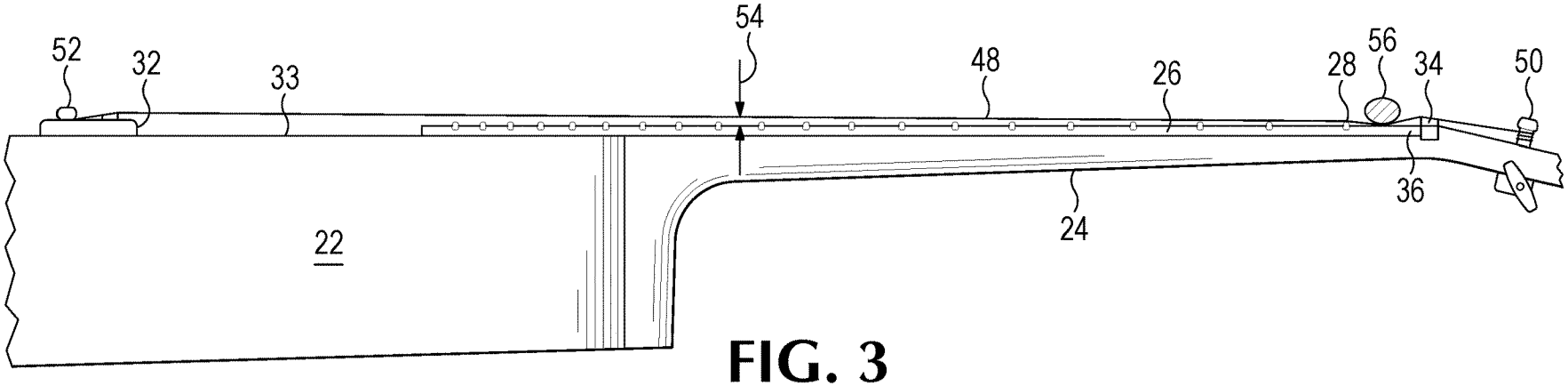
FIG. 3 is a side elevational view of the guitar shown in FIGS. 1 and 2, showing one of the strings fretted at the first fret, adjacent the nut.

Referring now to the drawings that form a part of the disclosure herein, a guitar 20 including the intonation system disclosed herein has a body 22 or tone body, and a neck 24 attached to and extending away from the body 22, as shown in FIGS. 1-3. The neck 24 includes a fingerboard 26, and frets 28, 30, etc., are mounted in the fingerboard 26, extending transversely across its width. There is a bridge assembly 32 mounted on the top, or soundboard, 33 of the body 22 and an adjustable nut 34 at the outer end 36 of the fingerboard 26.

Six strings 38, 40, 42, 44, 46, and 48 extend from the bridge 32 along the fingerboard 26 and over the nut 34 to respective tuning pegs 50, shown associated with respective tuning machines. The bridge end of each string 38, etc. is secured to the bridge 32 in the normal fashion in which the bridge end of the string extends down through a hole in the bridge 32 and is secured by a respective pin 52. The other, or free, end of each string 38, 40, etc., is wrapped around a respective one of the tuning pegs 50, by which the string is placed into tension in tuning the guitar 20.

When the strings 38, 40, etc., are in tension they are supported by and extend between the bridge 32 and the nut 34 with a certain amount of spacing 54, called the action height, between each string and the fingerboard 26.

Each string 38, 40, etc., when its entire length is free to vibrate, has a fundamental frequency, and an appropriate amount of tension establishes a desired fundamental frequency for each string 38, 40, etc., when the guitar 20 is tuned. As shown in FIGS. 2 and 3, a note higher than the fundamental frequency can be produced by the player using a finger 56 to press string 48, for example, against the fingerboard 26, so that the string 48 is forced into firm contact with the fret 30, the fret closest to the finger 56 and between the finger 56 and the bridge 32. The effective length of the string 48 is then the distance between the fret 30 and the bridge 32. At least a minimum action height 54 is required to keep a vibrating string from undesirably hitting the frets and causing an annoying buzzing sound, but greater action height requires greater effort to force the string against a fret. The action height 54 may be made to be the same along the length of the fingerboard by adjusting the angle at which the neck 24 extends away from the body 22, as is well known.

When a string is pressed down against the fingerboard 26 the string is necessarily elongated elastically at least a small amount, and the amount of tension in the string is increased slightly accordingly. In designing the fingerboard of a musical instrument this elongation and increase of tension in the string are considered in determining the proper placement of each fret 28, 30, etc., but as mentioned above, the characteristics of a particular string will result in more or less accuracy of the resulting vibrational frequency, or tone, of the fretted string. When a string is fretted near the middle of its length the amount of elongation required to effectively force the string against a fret may be different from the amount of elongation and force required to force the string against the first fret 28, as shown in FIG. 3.

Since the locations of the several frets along the fingerboard are fixed, if the vibrating frequency of a fretted string is too high, and if the degree of frequency error by which that string is too high increases with fretting the string doser and closer to the bridge, accuracy of the tone produced by the string can be improved to have a similar amount of error at each fret, by effectively lengthening the string at its bridge end, using the adjustable bridge assembly 32.

Figure 4:
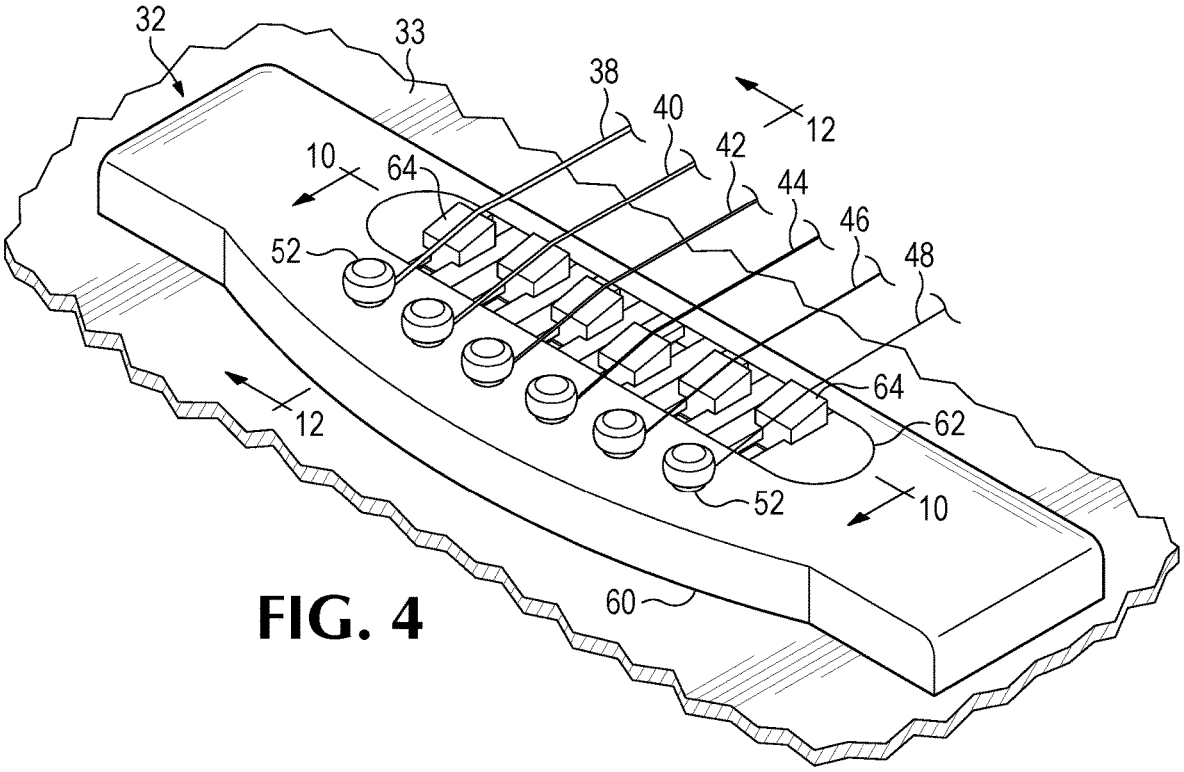
FIG. 4 is an isometric view of the bridge and a surrounding portion of the top of the guitar in FIG. 1.

Conversely, if the vibrating frequency of a fretted string is too low, and if the degree of frequency error by which by which the frequency of the fretted string is too low increases with fretting the string doser and closer to the bridge, accuracy of the tone produced by the string can be improved, to be more consistent over the several frets, by shortening the string at its bridge end, using the adjustable bridge assembly 32. That is, the bridge assembly 32, shown in FIG. 4, can be adjusted to lengthen or shorten each string at its bridge end, as will be explained in greater detail below.

When the frets 28, 30, etc. are located correctly on the fingerboard 26, with the appropriate distances between the frets, adjustment of the length of one of the strings 38, 40, etc. at the bridge assembly 32 may result in the string sounding too high by the same amount relative to its fundamental frequency at each of the frets along the fingerboard 26. That is, one of the strings may be in tune when it is open, but may sound too high in frequency by a small amount at each fret, including the first fret 28, the fret closest to the nut 34. Alternatively, the string where length has been adjusted at its bridge end may be in tune when it is open, but may sound too low in frequency by a similar small amount at each fret, including the first fret 28.

Figure 5:
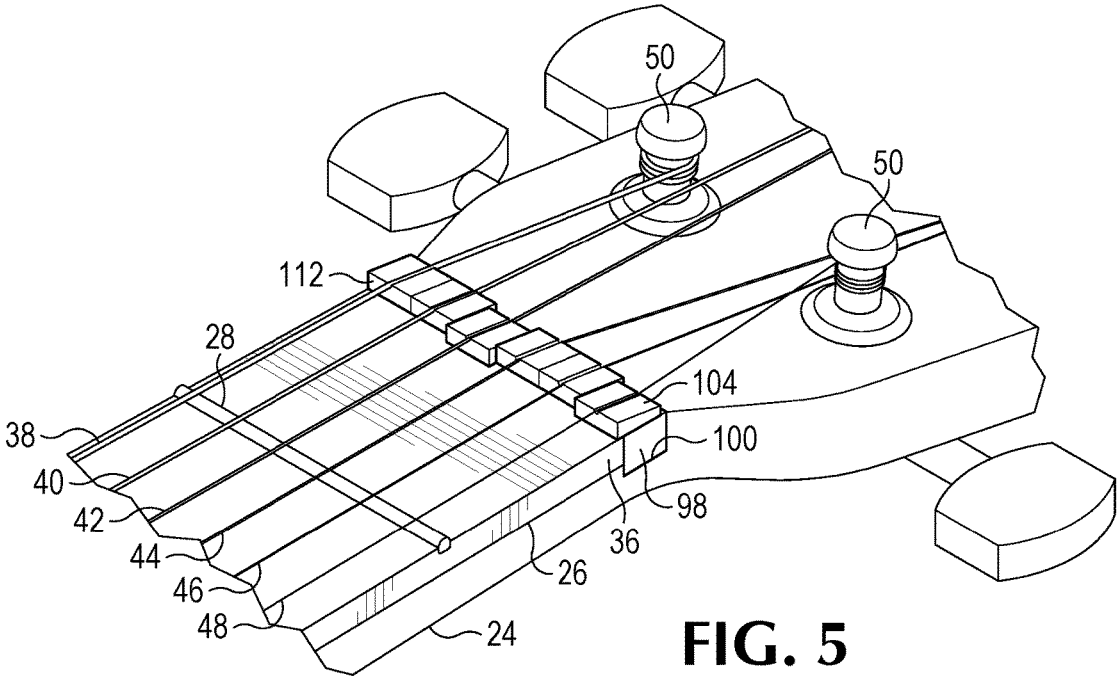
FIG. 5 is an isometric view of an outer end portion of the neck of the guitar shown in FIG. 1, showing the nut and portions of the strings of the guitar near the nut.
Figure 6:
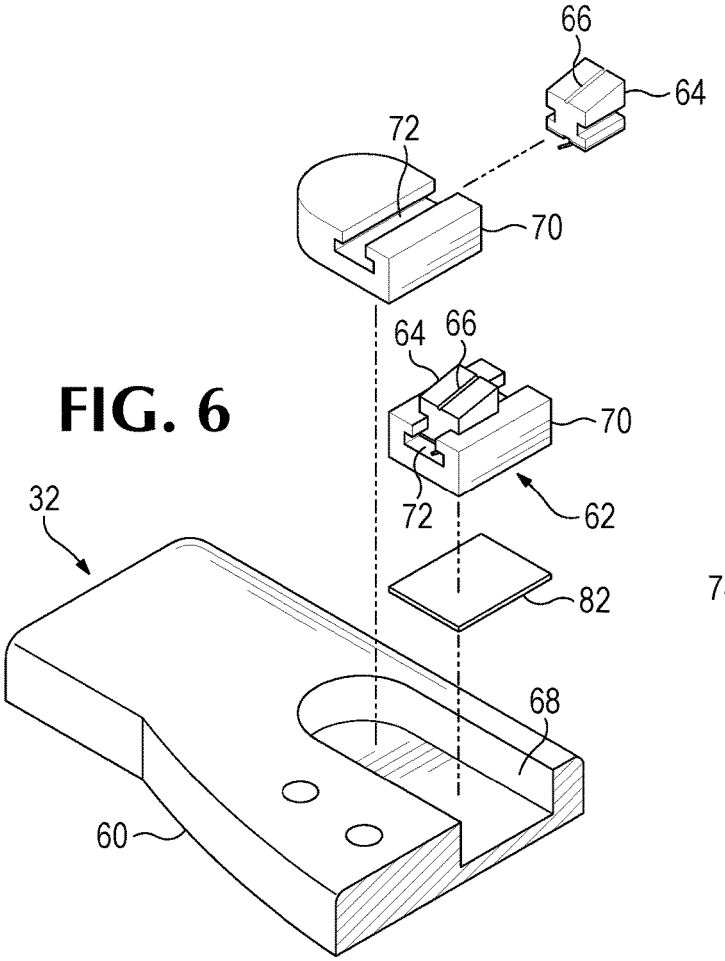
FIG. 6 is an exploded isometric view of a portion of the bridge shown in FIG. 4.

If a string that is in tune at its fundamental frequency produces a note that is too low when fretted on the first fret 28, the error can be corrected by adjustment of the adjustable nut 34, shown in FIG. 5, to effectively shorten the string at the nut end. Conversely, if the string sounds too high when fretted at the first fret 28, the error can be corrected by adjustment of the adjustable nut 34 to effectively lengthen the string at the nut and, as will be explained in greater detail below.

Referring to FIGS. 4 and 6-13, the bridge assembly 32 includes a bridge base member 60 which may be of hardwood and a plurality of bridge string saddle assemblies 62 each including a bridge string saddle element 64 that may be of a hard material such as bone, defining a string-receiving groove 66 in which one of the strings rests and from which the one of the strings extends away from the bridge base member 60 toward the nut 34.

The bridge base member 60 defines a saddle receptacle 68, a channel-like cavity defined in the bridge base member 60. Separate bridge string saddle assemblies 62 for each of the strings 38, 40, etc., are held in the saddle receptacle 68 closely alongside one another. Each bridge string saddle assembly 62 includes a saddle base member 70 that may be of hardwood and that defines a guide channel 72 with which a respective one of the bridge string saddle elements 64 is mated. The guide channel 72 defined in each saddle base member 70 is oriented parallel with the direction between the bridge assembly 32 and the nut 34, thus along the length of the respective one of the strings.

In the embodiment of the bridge assembly 32 shown herein, the guide channel 72 defined in each bridge saddle base member 70 as shown herein is a T-slot, and the associated bridge string saddle element 64 includes a lower portion 74 mated in the T-slot 72. The lower portion 74 of the bridge string saddle element 64 includes a downwardly extending web 76. A pair of oppositely-oriented flanges 78 extend laterally from respective sides of the web 76 and are disposed slidably within respective side grooves 80 of the T-slot in the saddle base member 70, with a certain amount of clearance, as will be apparent.

Figure 7:
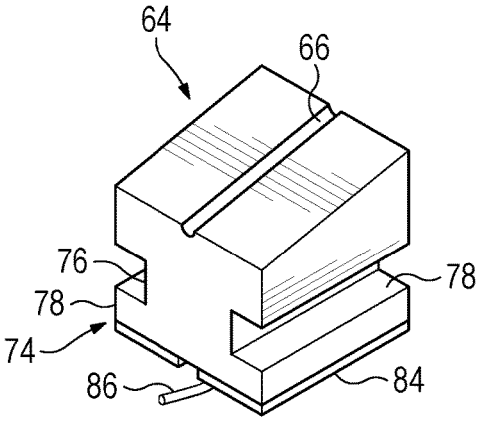
FIG. 7 is an isometric view of a bridge string saddle element such as one shown in FIG. 6, taken in the same direction, but at an enlarged scale.
Figure 7A:
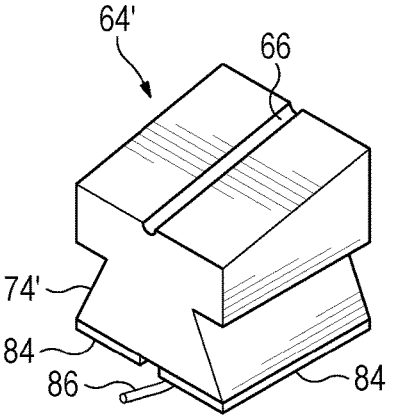
FIG. 7A is a view similar to FIG. 7, showing an alternative form of a bridge string saddle element.
Figure 9:
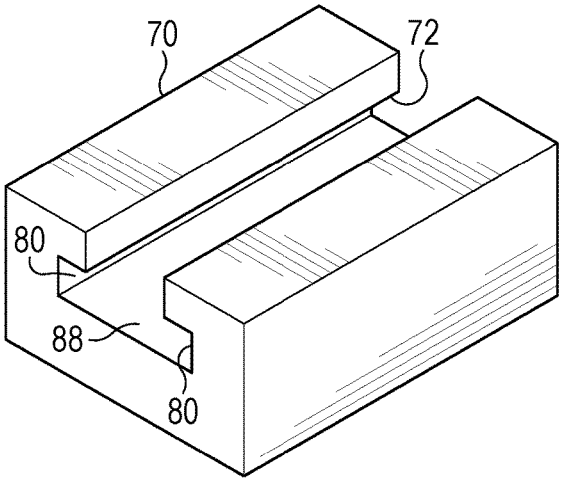
FIG. 9 is an isometric view of a saddle base member such as one shown in FIG. 6, at an enlarged scale.
Figure 9A:
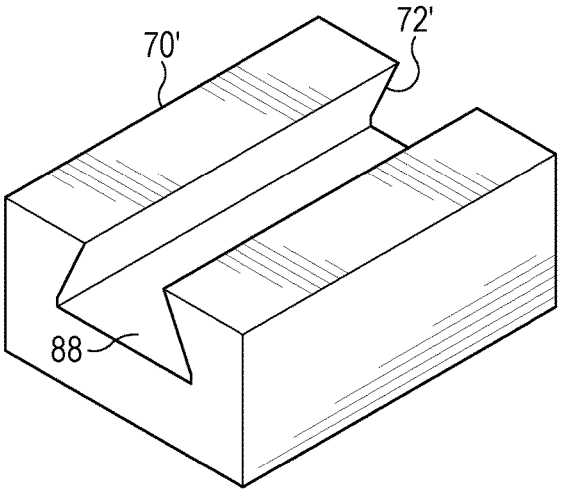
FIG. 9A is a view similar to FIG. 9, showing a saddle base member of an alternative form.

Alternatively, as shown in FIGS. 7A and 9A, instead of a T-slot in a bridge saddle base member 70' a guide channel 72' may be in the form of a dovetail slot and a lower portion 74' of a bridge string saddle element 64' may have a corresponding dovetail shape. Other shapes may also be acceptable, as will be understood, so long as the resulting bridge string saddle assembly can function as will be described presently.

A respective shim 82 of generally hard material such as a thin piece of hardwood may be located beneath one or more of the bridge saddle base members 70 in the receptacle 68 defined in the bridge base member 60, to adjust the height of the respective string saddle element with respect to the top 33 of the body 22. This may be desirable to provide a desired action height for a string, for example to accommodate an arched contour of the fingerboard 26 or the way a particular string vibrates. The preferred action height 54 for a particular string may, in some cases, depend upon the manner in which the instrument is to be played, as well as the material and size of the string.

Figure 8:
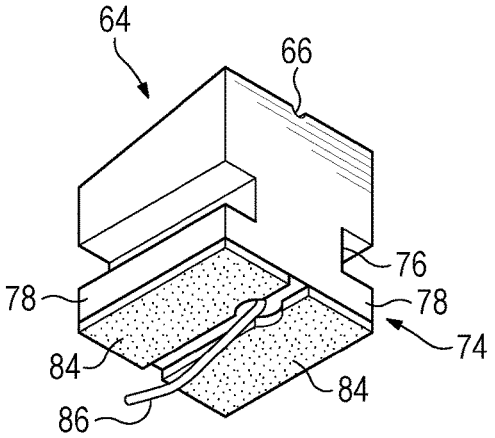
FIG. 8 is an isometric view of the string saddle shown in FIG. 7, taken from an opposite point of view.

As shown best in FIG. 8, the bottom 83 of each bridge string saddle element 64 may have a pair of small pieces of frictional material 84 such as fine-grit sandpaper glued in place with the frictional surface facing downward toward a bottom surface 86 of the T-slot 72 in which the bridge string saddle element 64 is mated.

Figure 10:
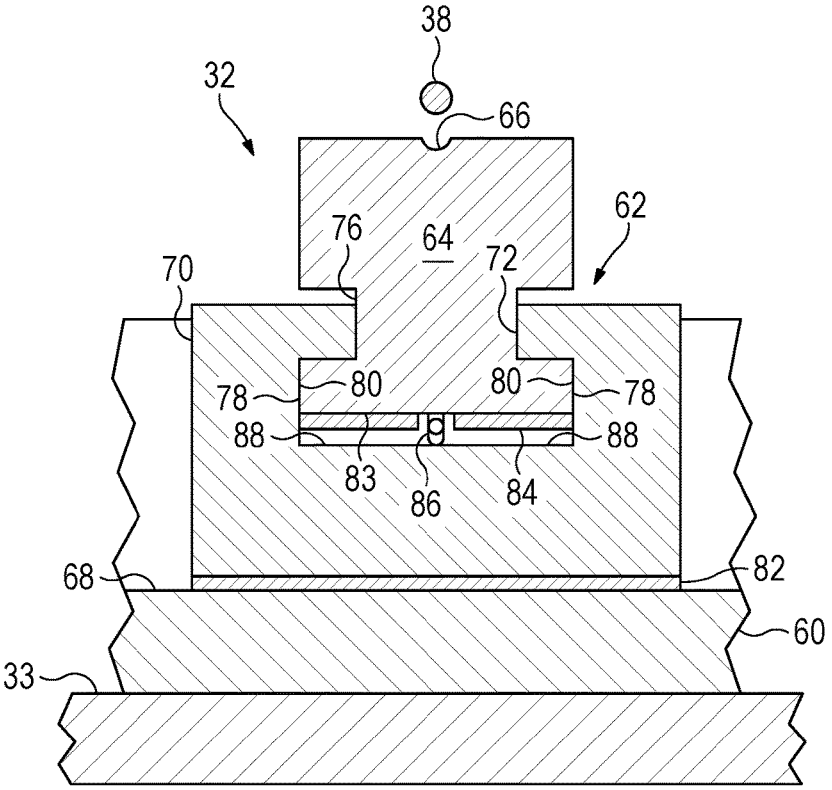
FIG. 10 is a sectional view, taken along line 10-10 in FIG. 4, at an enlarged scale.

Between the pieces of frictional material 84 there may be a small spring 86, for example, a small piece of spring wire, with an end fastened in the lower portion 74 of the bridge string saddle element 64, and with the wire extending along the bottom of the bridge string saddle element, at a small angle to the bottom of the bridge string saddle element and parallel with the guide channel 72 in which the bridge string saddle element 64 is located. The spring 86 thus protrudes downward a small distance beneath the frictional surface of the small pieces of sandpaper 84, as may be seen in FIGS. 7, 8, 10, and 12. By pressing against the bottom surface 88 of the guide channel 72 in the bridge saddle base member 70 the spring 86 urges the bridge string saddle element 64 upward toward the position shown in FIG. 10. The spring 86 should be strong enough so that if the associated string 38 or 40, etc., extending along the respective bridge string saddle element 64 is not in tension, as may be seen exaggerated in FIG. 10 with exaggerated clearance for better understanding, the spring 86 can raise the bridge string saddle element 64 slightly within the T-slot 72 and release the frictional members 84 from effective engagement against the bottom surface 88 of the T-slot guide channel 72 and press the flanges 78 against the upper interior surfaces of the side grooves 80 of the T-slot guide channel 72, as shown in FIG. 10. The spring 86 should press the flanges 78 of the string saddle element firmly enough against the upper interior surfaces of the side grooves 80 of the T-slot so that the bridge string saddle element 64 is not free to simply slide along within the guide channel 72 when tension in the associated guitar string 38, etc., is relaxed as shown in FIG. 10.

Figure 11:
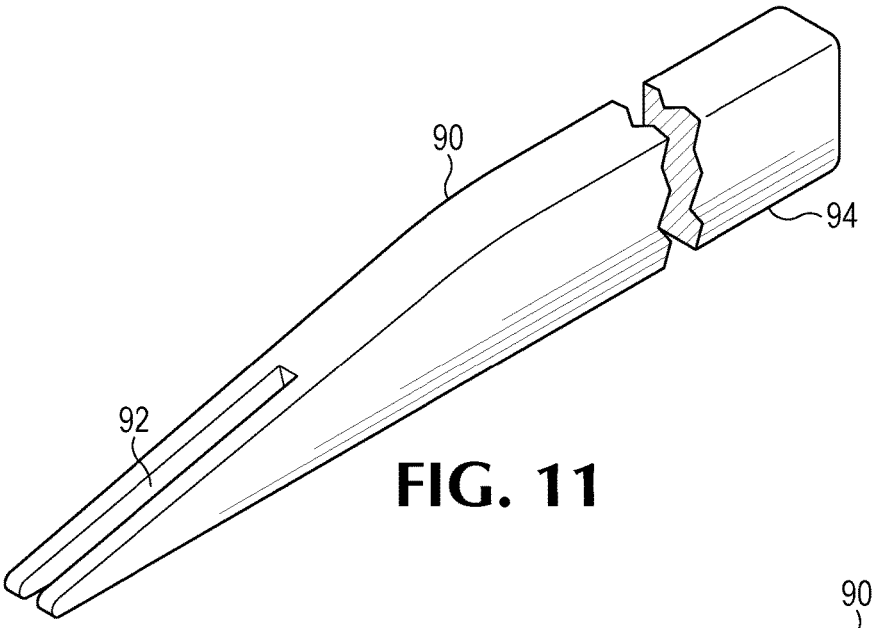
FIG. 11 is an isometric view of a portion of a tool for use in adjusting the position of a string saddle included in the bridge shown in FIG. 4.
Figure 12:
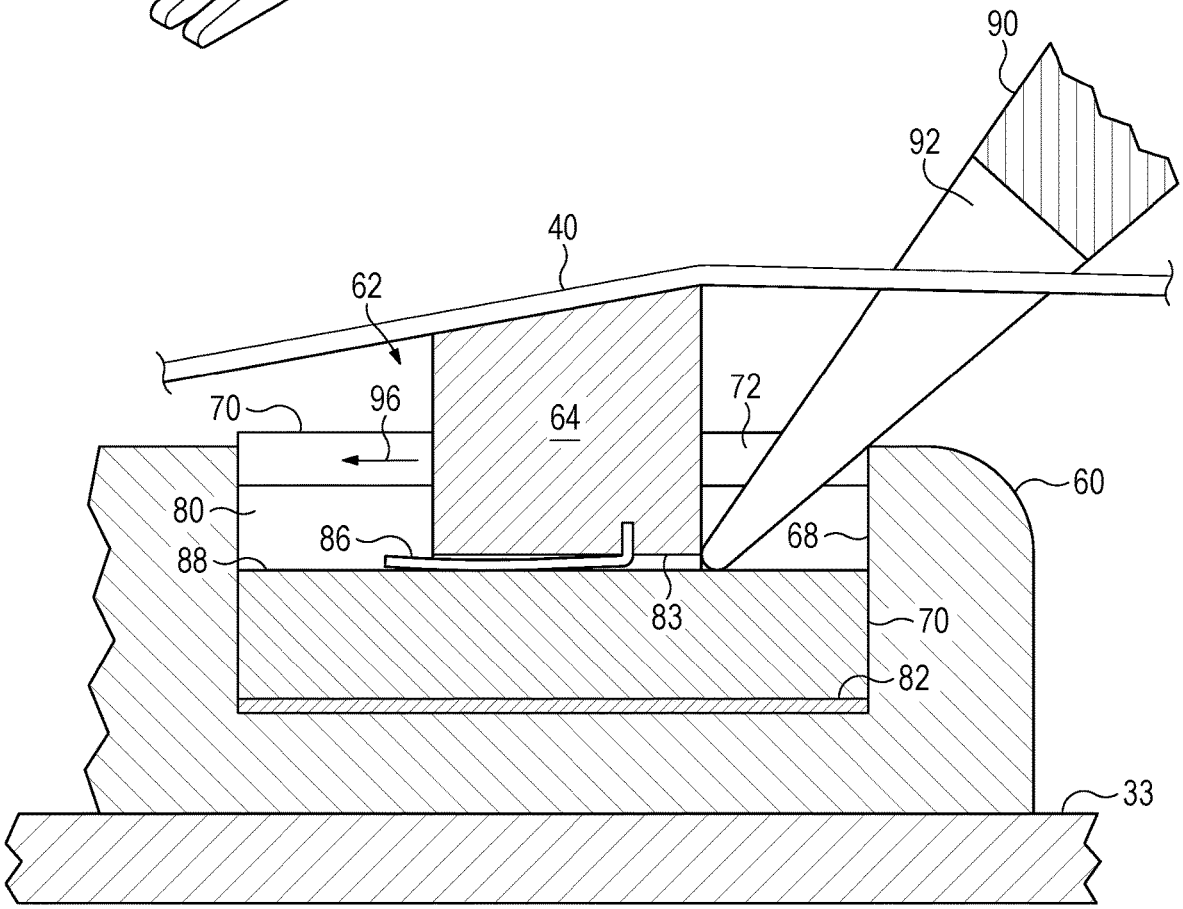
FIG. 12 is a sectional view, taken along line 12-12 in FIG. 4, at an enlarged scale, illustrating the manner of adjusting the bridge using the tool shown in FIG. 11.
Figure 13:
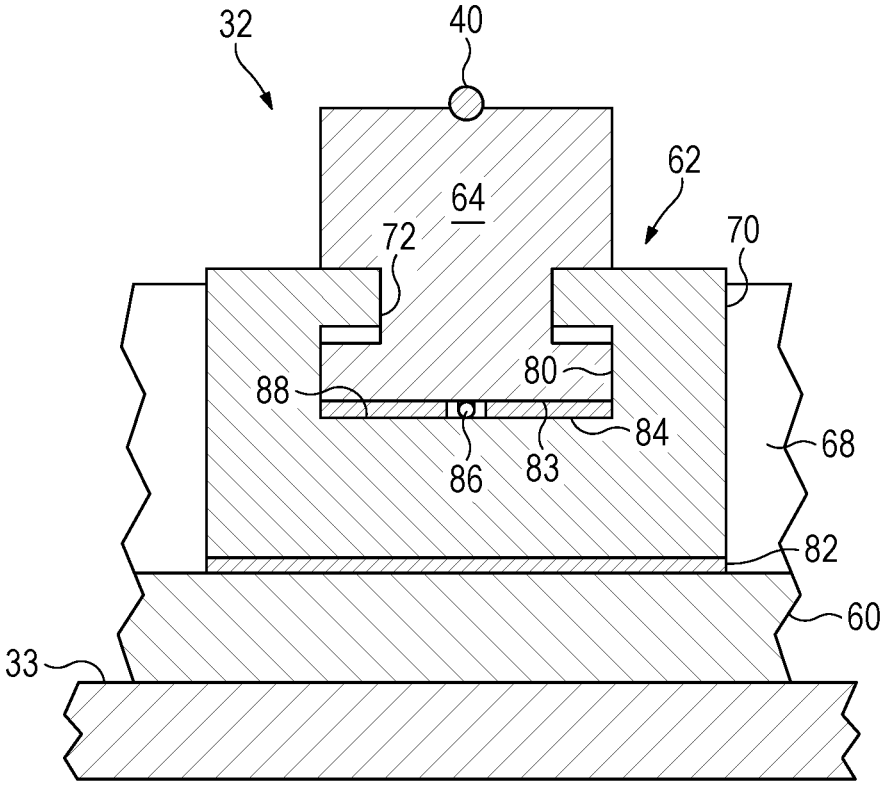
FIG. 13 is a view similar to FIG. 10, illustrating a portion of the bridge in the condition resulting when a string supported by the string saddle is in tension.

Referring now to FIGS. 11 and 12, a bridge string saddle adjustment tool 90 has a narrow tip defining a slot 92 large enough to receive any of the strings, and has a handle 94 of a desired length for convenient use. As illustrated in FIG. 12 the adjustment tool 90 is used as a lever to urge a selected one of the bridge string saddle elements 64 within the respective guide channel 72 in a desired direction with respect to the bridge base member 60 when the associated string is loosened enough so that the spring 86 is at least reducing the amount of pressure of the frictional material 84 against the bottom surface 88 of the guide channel 72, and the bridge string saddle element 64 may thus be in the position shown in FIG. 10. Movement of the bridge string saddle element 64 in the direction indicated by the arrow 96 shown in FIG. 12 will extend the length of the associated string at the bridge end.

Once the position of the bridge string saddle element 64 has been adjusted by a desired amount, tension may be restored in the associated string to bring it into tune. When the string 38, etc., is placed in tension the bridge string saddle element 64 is pressed downward within the T-slot guide channel 72 to the position shown in FIG. 13. That is, tension in the string overcomes the force of the spring 86 and presses the bridge string saddle element 64 down so that the frictional material 84 engages the bottom surface 88 of the guide channel 72 in the bridge saddle base member 70. The small movements of the string within and along the groove 66 in the bridge string saddle element 64 during subsequent tuning of the instrument will be insufficient to move the bridge string saddle element 64 with respect to the bridge saddle base member 70, and the effective length of the string at the bridge end will not be affected by tuning the instrument.

As shown in FIGS. 5 and 14-18, the adjustable nut allows the open length of each string 38, 40, 42, etc., to be adjusted at the nut end of the string, as may be desired for separately optimizing the intonation of each string of the instrument. A nut base member 98 is mounted in a transversely extending channel 100 in the neck 24, at the outer end 36 of the fingerboard 26. The nut base member 98 may preferably define several separate nut saddle receptacles 102 in the form of cavities, with a separate nut saddle receptacle 102 provided to receive a respective individual nut saddle 104 to support each string 38 or 40, etc., and hold it in its respective position with respect to the width of the fingerboard 26. Each such nut saddle receptacle 102 has a respective length 106, parallel with the length of the neck 24, and a width 108, in a direction across the length of the neck 24.

Figure 14:
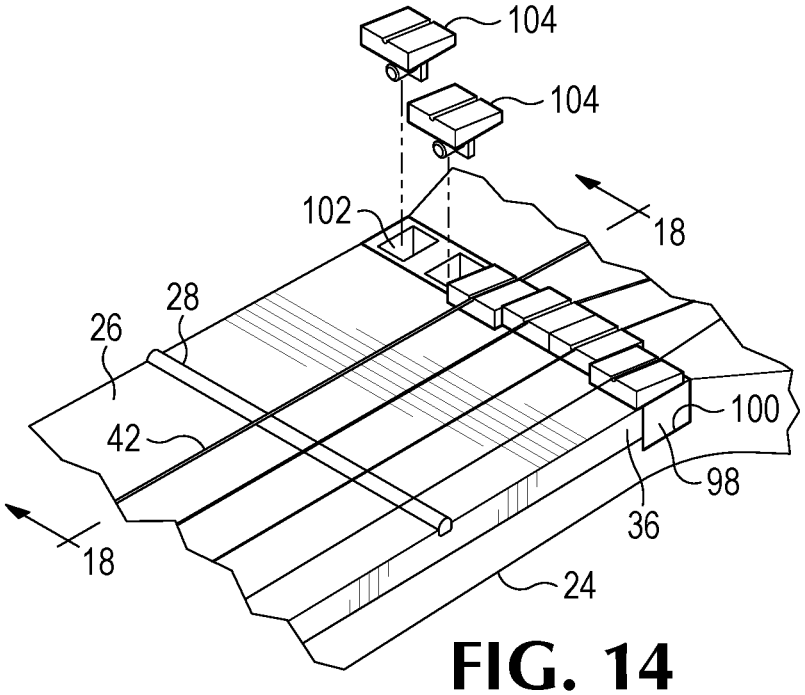
FIG. 14 is an isometric view of an outer end portion of the neck of the guitar shown in FIG. 1, showing the adjustable nut and a pair of adjustable nut saddles exploded away from the nut.
Figure 15:
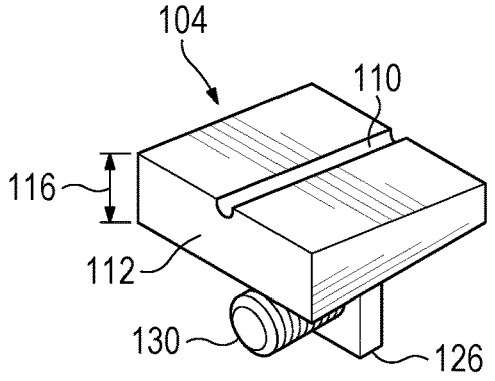
FIG. 15 is an isometric view, at an enlarged scale, of one of the adjustable nut saddles shown in FIG. 14.

A string receiving groove 110 extends along the top of each nut saddle 104, as may be seen in FIGS. 14 and 15. Each nut saddle 104 may be tapered in height in the direction in which the string receiving groove 110 extends, with the fingerboard side 112 of the nut saddle 104, located closer to the fingerboard 26 and the bridge 32, being highest. A string 38 or 40, etc., in tension and located in the string receiving groove 110 thus presses firmly against the nut saddle 104 at the fingerboard side 112 of the nut saddle 104, which defines the nut end of the open string length that is available to be tuned to its fundamental frequency.

Figure 16:
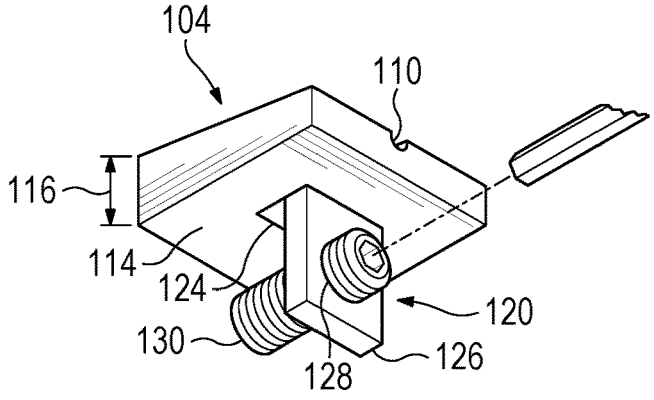
FIG. 16 is an isometric view of the adjustable nut saddle shown in FIG. 15, taken from an opposite point of view.
Figure 17:
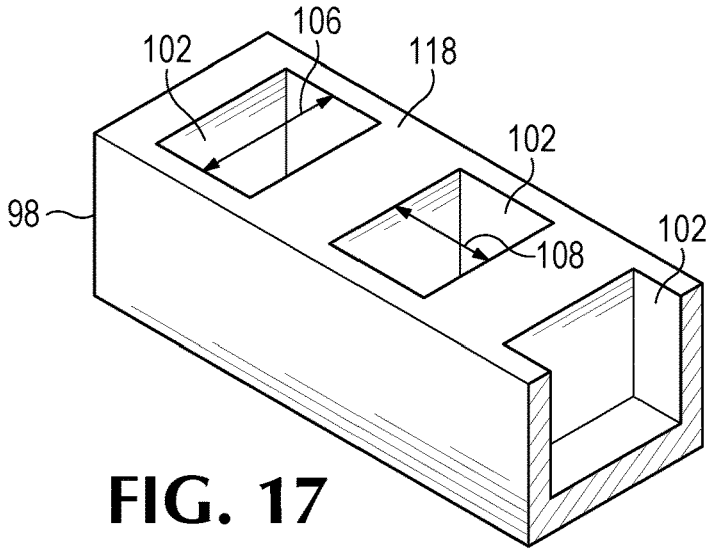
FIG. 17 is an isometric view, at an enlarged scale, of a portion of a base member of the adjustable nut shown in FIG. 14.

Each nut saddle 104 has a bottom surface 114, seen in FIG. 16, that rests against the generally planar top surface 118 of the nut base member 98 that surrounds the nut saddle receptacles 102. Depending upon the position of the nut saddle 104, as will be explained, the bottom surface 114 may also rest on the top of the fingerboard 26. The height 116 of the fingerboard side 112 of each nut saddle 104 establishes the action height 54 of a respective string with respect to the fingerboard 26, at the nut end of the string. The action height 54 at the nut end of a particular string may be adjusted, if desired, by exchanging a nut saddle 104 for one having a different height 116 of its fingerboard side 112.

Figure 18:
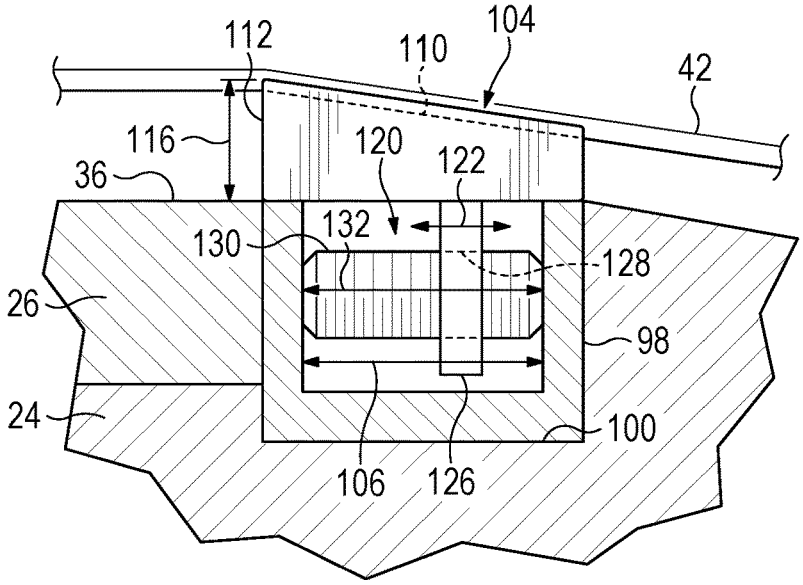
FIG. 18 is a sectional view taken along line 18-18 in FIG. 14, at an enlarged scale.

Each nut saddle 104 includes a position adjustment mechanism 120, shown in FIGS. 16 and 18, by which the position of the individual nut saddle 104 with respect to the nut base member 98 may be adjusted in the direction of the arrow 122. The location of each nut saddle 104 thus may be adjusted toward or away from the bridge 32 parallel with the length 106 of the respective nut saddle receptacle 102, as shown best in FIG. 18. The position adjusting mechanism 120 includes a bracket 124, attached to the bottom 114 of the respective nut saddle 104. The bracket 124 may be inset in the bottom 114 of the respective nut saddle and attached by an adhesive. The bracket 124 includes a depending member 126 in which there is a threaded hole 128 that extends parallel with the bottom surface 114 of the nut saddle 104 and in a plane that includes the string receiving groove 110. A saddle adjusting screw 130 is engaged in the threaded hole 128 and preferably has a length 132 equal to the length 106 of the respective nut saddle receptacle 102, so that the adjusting screw can contact an interior surface of the saddle receptacle and the position of the saddle adjusting screw 130 in the depending member 126 establishes the position of the fingerboard side 112 of the nut saddle 104 in the direction of the arrow 122, with respect to the nut base member 98.

The open length of each string 38, 40, etc., may be adjusted at its nut end by loosening the string enough to lift the string from the nut saddle and move it aside far enough to give free access to permit the respective nut saddle 104 to be removed from its receptacle 102 in the nut base member 98. The position of the nut saddle 104 with respect to the nut base member 98 can be changed in the direction of the arrow 122 by adjusting the screw 130 in the depending member 126, as suggested by FIG. 16. When the nut saddle 104 is returned to its receptacle 102 in the nut base member 98 the nut saddle 104 will be in an adjusted position, with its fingerboard side 112 moved toward or away from the bridge 32.

Once a stringed instrument such as the guitar 20 is initially set up, perhaps by adjustment of the angle of the neck 24 with respect to the body 22, and strings are installed, the intonation can be adjusted using the adjustable bridge 32 and adjustable nut 34 as described above to optimize the intonation of each string separately. The intonation of an instrument equipped with the adjustable bridge 32 and adjustable nut 34 may be adjusted to accommodate different strings or to optimize the sound of the instrument if it is to be played in a different style, but the appearance of the instrument remains very traditional, without the mechanical aspects of the bridge 32 or nut 34 being apparent without close inspection.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An intonation system for a multi-stringed musical instrument having a bridge mounted on a tone body and a neck having an outer end, comprising:

(a) an adjustable bridge including a base member and a plurality of saddle assemblies each including a bridge string saddle element defining a string-receiving groove and each string saddle element being movable with respect to the base member through a range of potential positions, in a direction parallel with the string-receiving groove;

(b) an adjustable nut including a nut base member defining a plurality of saddle receptacle, the nut also including a nut saddles each resting on the nut base member and each including a string-receiving groove and having a bottom and an adjustment mechanism including a member depending below the bottom of the nut saddle and extending into the saddle receptacle and arranged to interact with an interior surface of the saddle receptacle to cause a respective nut saddle to be located in a selected position, within a range of potential positions with respect to the nut base member in a direction toward or away from the bridge and to retain the respective nut saddle in the respective nut saddle in the selected position.

2. The intonation system of claim 1 wherein one of the bridge saddle assemblies includes a saddle base member defining a guide channel and a respective bridge string saddle element is mated with the saddle base member and movable with respect to the saddle base member in a direction established by the guide channel, through the range of potential positions.

3. The intonation system of claim 2, wherein the guide channel defined by the saddle base member is a T-slot and wherein the respective bridge string saddle element includes a lower portion mated in the T-slot and arranged to maintain a directional orientation of the respective one of the string saddles with respect to the saddle base member with which it is mated.

4. An intonation system for a multi-stringed musical instrument having a bridge mounted on a tone body and a neck having an outer end, comprising:

(a) an adjustable bridge including a base member and a plurality of saddle assemblies each including a bridge string saddle element defining a string receiving groove, each string saddle element being movable with respect to the base member through a range of potential positions, in a direction parallel with the string-receiving groove;

(b) wherein one of the bridge saddle assemblies includes a saddle base member defining a guide channel and a respective bridge string saddle element is mated with the saddle base member and movable with respect to the saddle base member in a direction established by the guide channel, through the range of potential positions;

(c) wherein the guide channel defined by the saddle base member is a T-slot and wherein the respective bridge string saddle element includes a lower portion mated in the T-slot and arranged to maintain a directional orientation of the respective one of the string saddles with respect to the saddle base member with which it is mated;

(d) wherein the lower portion of the bridge string saddle element includes a depending web and a pair of flanges extending away from the web and engaged in the T-slot, the flanges each having a bottom face and a limited amount of clearance in a direction normal to the bottom face, and wherein the bridge string saddle assembly includes a layer of a frictional material between the bottom face and an opposing interior surface of the T-slot, and wherein a string of the stringed instrument, when supported by the one of the bridge string saddle assemblies, urges the bottom face of each of the flanges and the layer of frictional material against the opposing interior surface of the T-slot, thus keeping the respective bridge string saddle element from moving with respect to the saddle base member with which it is mated; and (e) an adjustable nut including a nut base member defining a plurality of saddle receptacles and including a plurality of nut saddles each held in a respective saddle receptacle and each including a string-receiving groove and an adjustment mechanism arranged to interact with the respective saddle receptacle to retain each nut saddle in a selected position of adjustment in a direction parallel with the respective string-receiving groove and within a range of potential positions with respect to the nut base member.

5. An intonation system for a multi-stringed musical instrument having a bridge mounted on a tone body and a neck having an outer end, comprising:

(a) an adjustable bridge including a base member and a plurality of saddle assemblies each including a bridge string saddle element defining a string-receiving groove and each string saddle element being movable with respect to the base member through a range of potential positions, in a direction parallel with the string-receiving groove;

(b) wherein one of the bridge saddle assemblies includes a saddle base member defining a guide channel and a respective bridge string saddle element is mated with the saddle base member and movable with respect to the saddle base member in a direction established by the guide channel, through the range of potential positions;

(c) wherein the guide channel defined by the saddle base member is a T-slot and wherein the respective bridge string saddle element includes a lower portion mated in the T-slot and arranged to maintain a directional orientation of the respective one of the string saddles with respect to the saddle base member with which it is mated;

(d) including a spring carried on the portion of the bridge string saddle element that is located within the guide channel and adapted to make the bridge string saddle element rise to a position of clearance above a bottom of the guide channel, and to keep the string saddle from being so loose that it can slide freely in the guide; and (e) an adjustable nut including a nut base member defining a plurality of saddle receptacles and including a plurality of nut saddles each held in a respective saddle receptacle and each including a string-receiving groove and an adjustment mechanism arranged to interact with a respective saddle receptacle to retain each nut saddle in a selected position of adjustment in a direction parallel with the respective string-receiving groove and within a range of potential positions with respect to the nut base member.

6. An intonation system for a multi-stringed musical instrument having a bridge mounted on a tone body and a neck having an outer end, comprising:

(a) an adjustable bridge including a base member and a plurality of bridge string saddle assemblies each including a string saddle element defining a string-receiving groove and each string saddle element being movable with respect to the base member through a range of potential positions, in a direction parallel with the string-receiving groove;

(b) wherein the base member of the bridge defines a saddle receptacle cavity, one of the bridge string saddle assemblies being located in the saddle receptacle cavity, and the adjustable bridge including a shim located within the saddle receptacle cavity, beneath the one of the bridge string saddle assemblies, the shim having a thickness selected to support the one of the bridge string saddle assemblies at a selected height with respect to the tone body of the stringed musical instrument; and (c) an adjustable nut including a nut base member defining a plurality of saddle receptacles and including a plurality of nut saddles each resting on the nut base member and each including a string-receiving groove and an adjustment mechanism extending into and, arranged to interact with an interior surface of a respective saddle receptacle to cause a respective nut saddle to be located in a selected position within a range of available positions with respect to the nut base member, in a direction toward or away from the bridge, and to retain the respective nut saddle in the selected position.

7. A stringed musical instrument including an intonation adjustment system, the musical instrument comprising:

(a) a tone body;

(b) a neck extending from the body;

(c) a fingerboard extending along the neck and having an outer end;

(d) a bridge mounted on the body;

(e) a nut located at the outer end of the fingerboard; and (f) a plurality of strings extending from the bridge and along the fingerboard to the nut; and wherein (g) the bridge includes a base member and a plurality of separate bridge string saddle assemblies mounted in the bridge base member, each bridge string saddle assembly including a bridge string saddle element that is movable within an available range of potential positions with respect to the bridge base member, in a direction toward or away from the nut, and each bridge string saddle element thus establishing a bridge end of a vibrating length of a respective one of the plurality of strings at a selected position with respect to the bridge base member; and wherein (h) the nut includes a nut base member defining a saddle receptacle, the nut including a plurality of nut saddles each resting on the nut base member and each including a string-receiving groove and each including an adjustment mechanism including a member depending from a bottom of a respective nut saddle and extending into the saddle receptacle and arranged to interact with the saddle receptacle to cause the respective nut saddle to be located in a selected position within a range of potential positions with respect to the nut base member in a direction toward or away from the bridge, and to retain the respective nut saddle in the selected position, and each nut saddle thus establishing a nut end of a vibrating length of the respective one of the plurality of strings at a selected position with respect to the nut base member.

8. The stringed musical instrument of claim 7 wherein one of the bridge saddle assemblies includes a saddle base member defining a guide channel and a respective saddle element is mated with the saddle base member and movable with respect to the saddle base member in a direction established by the guide channel, through an available range of potential positions.

9. The stringed musical instrument of claim 8, wherein the guide channel defined by the saddle base member is a T-slot and wherein the respective string saddle element includes a lower portion mated in the T-slot and arranged to maintain a directional orientation of the respective one of the bridge string saddle elements with respect to the saddle base member with which it is mated.

10. A stringed musical instrument including an intonation adjustment system, the musical instrument comprising:

(a) a tone body;

(b) a neck extending from the body;

(c) a fingerboard extending along the neck and having an outer end;

(d) a bridge mounted on the body;

(e) a nut located at the outer end of the fingerboard; and (f) a plurality of strings extending from the bridge and along the fingerboard to the nut;

(g) wherein the bridge includes a base member and a plurality of separate bridge string saddle assemblies mounted in the bridge base member, each bridge string saddle assembly including a string saddle element that is movable within an available range of potential positions with respect to the bridge base member, in a direction toward or away from the nut, and each string saddle element thus establishing a bridge end of a vibrating length of a respective one of the plurality of strings at a selected position with respect to the bridge base member;

(h) wherein the bridge base member defines a saddle receptacle cavity, one of the bridge string saddle assemblies being located in the saddle receptacle cavity, and the bridge including a shim located within the saddle receptacle cavity beneath the one of the bridge string saddle assemblies, the shim having a thickness selected to support the one of the bridge string saddle assemblies at a selected height with respect to the tone body of the stringed musical instrument; and wherein (i) the nut includes a nut base member defining a plurality of saddle receptacles and including a plurality of nut saddles each resting on the nut base member and each including an adjustment mechanism extending into and arranged to interact with an interior surface of a respective saddle receptacle to cause a respective nut saddle to be located in a selected position of adjustment and to retain the respective nut saddle in the selected position of adjustment, within an available range of potential positions with respect to the nut base member, in a direction toward or away from the bridge, and each nut saddle thus establishing a nut end of a vibrating length of the respective one of the plurality of strings at the selected position of adjustment.

11. A stringed musical instrument including an intonation adjustment system, the musical instrument comprising:

(a) a tone body;

(b) a neck extending from the body;

(c) a fingerboard extending along the neck and having an outer end;

(d) a bridge mounted on the body;

(e) a nut located at the outer end of the fingerboard; and (f) a plurality of strings extending from the bridge and along the fingerboard to the nut; and wherein (g) the bridge includes a base member and a plurality of separate bridge string saddle assemblies mounted in the bridge base member, each bridge string saddle assembly including a string saddle element that is movable within an available range of potential positions with respect to the bridge base member, in a direction toward or away from the nut, and each string saddle element thus establishing a bridge end of a vibrating length of a respective one of the plurality of strings at a selected position with respect to the bridge base member;

(h) wherein one of the bridge saddle assemblies includes a saddle base member defining a guide channel and a respective saddle element is mated with the saddle base member and movable with respect to the saddle base member in a direction established by the guide channel, through an available range of potential positions;

(i) wherein the guide channel defined by the saddle base member is a T-slot and wherein the respective string saddle element includes a lower portion mated in the T-slot and arranged to maintain a directional orientation of the respective one of the bridge string saddle elements with respect to the saddle base member with which it is mated;

(j) wherein the lower portion of the bridge string saddle element includes a depending web and a pair of flanges extending away from the web and engaged in the T-slot, the flanges each having a bottom face and a limited amount of clearance in a direction normal to the bottom face, and wherein the one of the bridge string saddle assemblies includes a layer of a frictional material between the bottom face and an opposing interior surface of the T-slot, and wherein a string of the stringed instrument, when supported by the respective bridge string saddle element urges the bottom face of each of the flanges against the opposing interior surface of the T-slot, thus keeping the respective bridge string saddle element from moving with respect to the saddle base member with which it is mated; and (k) a nut base member included in the nut and defining a plurality of saddle receptacles and including a plurality of nut saddles each held in a respective saddle receptacle and each including an adjustment mechanism arranged to interact with the respective saddle receptacle to retain each nut saddle in a selected position of adjustment, within an available range of potential positions with respect to the nut base member, in a direction toward or away from the bridge, each nut saddle thus establishing a nut end of the vibrating length of the respective one of the plurality of strings at a selected position with respect to the nut base member.

12. A stringed musical instrument including an intonation adjustment system, the musical instrument comprising:

(a) a tone body;

(b) a neck extending from the body;

(c) a fingerboard extending along the neck and having an outer end;

(d) a bridge mounted on the body;

(e) a nut located at the outer end of the fingerboard; and (f) a plurality of strings extending from the bridge and along the fingerboard to the nut; and wherein (g) the bridge includes a base member and a plurality of separate bridge string saddle assemblies mounted in the bridge base member, each bridge string saddle assembly including a string saddle element that is movable within an available range of potential positions with respect to the bridge base member, in a direction toward or away from the nut, and each string saddle element thus establishing a bridge end of a vibrating length of a respective one of the plurality of strings at a selected position with respect to the bridge base member;

(h) wherein one of the bridge saddle assemblies includes a saddle base member defining a guide channel and a respective saddle element is mated with the saddle base member and movable with respect to the saddle base member in a direction established by the guide channel, through an available range of potential positions;

(i) the one of the bridge saddle assemblies including a spring, carried on the portion of the bridge string saddle element that is located within the guide channel and adapted to make the bridge string saddle element rise to a position of clearance above a bottom of the guide channel, and to keep the string saddle from being so loose that it can slide freely in the guide; and (j) a nut base member included in the nut and defining a plurality of saddle receptacles and including a plurality of nut saddles each held in a respective saddle receptacle and each including an adjustment mechanism arranged to interact with the respective saddle receptacle to retain each nut saddle in a selected position of adjustment, within an available range of potential positions with respect to the nut base member, in a direction toward or away from the bridge, each nut saddle thus establishing a nut end of a vibrating length of the respective one of the plurality of strings at a selected position with respect to the nut base member.

* * * * *